US008234841B2

(12) United States Patent
Wild et al.

(10) Patent No.: US 8,234,841 B2
(45) Date of Patent: Aug. 7, 2012

(54) APPARATUS AND METHOD FOR FILLING FLEXIBLE FOIL BAGS

(75) Inventors: Hans-Peter Wild, Eppelheim/Heidelberg (DE); Hans Kepert, Ladenburg (DE)

(73) Assignee: Deutsche Sisi-Werke Betriebs GmbH, Eppelheim (DE)

( * ) Notice: Subject to any disclaimer, the term of this patent is extended or adjusted under 35 U.S.C. 154(b) by 1094 days.

(21) Appl. No.: 11/121,546

(22) Filed: May 4, 2005

(65) Prior Publication Data

US 2005/0257502 A1 Nov. 24, 2005

(30) Foreign Application Priority Data

May 21, 2004 (EP) ..... 04012124

(51) Int. Cl.
*B65B 31/04* (2006.01)

(52) U.S. Cl. ..... 53/434; 53/284.7; 53/469; 53/512; 53/79

(58) Field of Classification Search ..... 53/426, 53/428, 431, 432, 434, 459, 468, 510, 511, 53/385.1, 111 R, 425, 469, 79, 284.7, 512, 53/570, 384.1
See application file for complete search history.

(56) References Cited

U.S. PATENT DOCUMENTS 3,398,503 A * 8/1968 Bertoglio ..... 53/570
3,430,414 A * 3/1969 Ludwig et al. ..... 53/79
3,531,908 A * 10/1970 Tuma et al. ..... 53/426
3,619,975 A * 11/1971 Johnson et al.
3,708,952 A * 1/1973 Schulze et al. ..... 53/512
3,939,287 A * 2/1976 Orwig et al. ..... 426/316
4,112,124 A * 9/1978 Jarvis ..... 426/234
4,418,513 A * 12/1983 Plahm ..... 53/434
4,524,563 A * 6/1985 Sassi ..... 53/426
4,712,360 A * 12/1987 Bertoglio ..... 53/567
4,832,096 A * 5/1989 Kohlbach ..... 141/114
963,144 A 11/1990 Senior et al.
5,382,406 A * 1/1995 Kruger et al. ..... 422/28
5,514,123 A * 5/1996 Adolf et al. ..... 604/411
5,558,135 A * 9/1996 Kronseder et al. ..... 141/6
5,928,607 A * 7/1999 Frisk ..... 422/29
5,997,827 A * 12/1999 Mezger et al. ..... 422/292
6,073,424 A * 6/2000 Kraft et al. ..... 53/570
6,351,924 B1 * 3/2002 Gustafsson et al. ..... 53/425

(Continued)

FOREIGN PATENT DOCUMENTS

CN 1146916 A 4/1997

(Continued)

OTHER PUBLICATIONS

Notice of Reason for Rejection for Japanese Patent Application No. P2005-150088 dispatch date Feb. 20, 2007.

(Continued)

*Primary Examiner* — Thanh Truong
(74) *Attorney, Agent, or Firm* — Stroock & Stroock & Lavan LLP

(57) ABSTRACT

A method of filling flexible foil bags, wherein a foil bag is shaped at least partially by a gaseous medium and is then filled with a liquid filling material, with the gaseous medium disinfecting the foil bag. Also, an apparatus for filling foil bags comprising a shaping unit for shaping the foil bags using a gaseous medium, a filling unit for filling the foil bags with a liquid medium, with the ability of adding a disinfecting effect to the gaseous medium.

16 Claims, 3 Drawing Sheets

U.S. PATENT DOCUMENTS

2002/0159915 A1 10/2002 Zelina et al.

FOREIGN PATENT DOCUMENTS

| | | | |
|---|---|---|---|
| DE | 1 536 019 | | 11/1969 |
| DE | 1 916 636 | | 10/1970 |
| DE | 25 11 355 | | 10/1975 |
| EP | 0222309 | A1 | 5/1987 |
| EP | 0908386 | A1 | 4/1998 |
| GB | 9639144 | A | 7/1964 |
| JP | A-60-217929 | | 10/1985 |
| JP | 2001-58602 | | 3/2001 |
| JP | A 2004-066718 | | 3/2004 |
| JP | A-05-178330 | | 7/2005 |

OTHER PUBLICATIONS

First Office Action for Chinese Patent Application No. 200510073738 dispatch date Mar. 23, 2007.

Kim, J. G., Abstract entitled "Application of Ozone for Enhancing the Microbiological Safety and Quality of Foods: A Review", A Journal of Food Protection, vol. 62, Issue 9, Sep. 1999, pp. 1071-1087.

Kim, J.G., Abstract entitled "Ozone and its Current and Future Application in the Food Industry" Advances in Food and Nutrition Research, vol. 45, 2003, pp. 167-218.

Sakurai, M., Abstract entitled "Several Factors Affecting Ozone Gas Sterilization"; Biocontrol Science, vol. 8, Issue 2, Jun. 2003, pp. 69-76.

* cited by examiner

APPARATUS AND METHOD FOR FILLING FLEXIBLE FOIL BAGS

REFERENCE TO RELATED APPLICATION

This disclosure claims priority to European application no. 04012124.6, filed May 21, 2004.

FIELD OF THE DISCLOSURE

The disclosure relates to a method and an apparatus for filling flexible foil bags, of the type which are to be filled and are stored in a folded condition before they are filled. In order to allow filling of said foil bags, such bags are shaped into an inflated state before they are filled, i.e. the cavity is created into which the filling material is to be filled.

BACKGROUND OF THE DISCLOSURE

For this purpose, it is known from EP 0417810, EP 0908386 and EP 0900708 that the foil bags are shaped by inflating them with air.

The shaped foil bags are subsequently filled with the filling material (cf. EP 0900708); in so doing, the filling material is, for hygienic reasons, filled into the foil bags in a hot condition for the purpose of disinfection.

Following this, the foil bags are sealed so that the filling material is packed in a hygienically perfect condition and can thus be stored, even under normal ambient conditions, for a long time without going bad.

The filled foil bags must then be cooled for further treatment.

Due to the complex cooling, it is rather expensive to operate these plants.

SUMMARY OF THE DISCLOSURE

It is therefore the object of the present disclosure to provide a method and an apparatus which are less expensive in operation.

According to the method, the foil bag is shaped by means of a gaseous medium, the foil bag being already disinfected by said gaseous medium. It follows that heating of the liquid filling material prior to the filling process can be avoided at least partially. This means that the filling material need not be heated at all, or, in comparison with the prior art, only to a lesser extent. Hence, the cooling power of the cooling means can be reduced as well. This will also have the effect that the filling material is treated gently, since heating of the filling material may impair the same.

The term disinfect means here that germs, bacteria or the like are reduced to such an extent that the product will not be impaired by them during its lifetime. This also comprises full sterilization in the case of which germs, bacteria or the like will no longer exist.

According to an advantageous embodiment of the method, the gaseous medium is a pure gas, such as nitrogen, oxygen or an inert gas, or a gas mixture, such as e.g. air. It will be of advantage when the gaseous medium is disinfected and/or sterile.

The disinfecting effect of the gaseous medium is achieved by an addition of ozone and/or hydrogen peroxide or the like.

In accordance with a particularly advantageous embodiment, the bag is evacuated before it is shaped by means of the gaseous medium. By means of this evacuation it is achieved that, when the foil bag is shaped by means of the gaseous medium, said gaseous medium will reach every corner and nook of the flat bag, whereby a more reliable disinfecting effect will be produced in the whole interior of the foil bag.

According to another embodiment, the bag may be evacuated also after having been shaped, so as to remove the disinfecting gaseous medium. Subsequently, the foil bag can be shaped once more by means of a disinfected and/or sterile gaseous medium and/or the filling material.

It is also possible to rinse out the disinfecting gaseous medium by means of a disinfected and/or sterile medium (e.g. sterile hot air), when the bag has been shaped.

According to an advantageous embodiment, it is also possible to introduce only a small amount of disinfecting gaseous medium into the foil bag and to fully shape said foil bag subsequently by means of a disinfected and/or sterile gaseous medium (e.g. sterile hot air). In this case, the foil bag is partially shaped by means of the disinfecting gaseous medium.

According to another advantageous embodiment of the method, it is possible to heat the gaseous medium before it is used for the purpose of shaping the bag. A sufficient disinfecting effect can already be achieved by heating the gaseous medium alone. However, also the disinfecting effect of ozone or hydrogen peroxide or the like can be increased by such heating, if these substances have been added to the gaseous medium.

The apparatus comprises a shaping unit for shaping the foil bags by means of a gaseous medium, and a filling unit for filling the foil bags with a liquid medium. Furthermore, the apparatus comprises means which render the gaseous medium disinfecting. These means can be means for heating the gaseous medium and/or for adding ozone and/or hydrogen peroxide or the like to said gaseous medium.

Ozone or hydrogen peroxide can be added to a carrier gas so as to form the gaseous medium. This can be done by means of a metering valve, a metering pump or the like.

It is also possible to produce ozone by irradiating oxygen or air, the ozone being added to the gaseous medium in this way.

According to an advantageous embodiment, the apparatus comprises an evacuating unit and/or a sealing unit for the bags.

The evacuating unit can be implemented such that it serves to evacuate the bags before they are shaped, or such that it serves to evacuate said bags after the first shaping. In the latter case, a second shaping unit can be used for forming the foil bags.

Furthermore, it will be advantageous to provide the apparatus with a rinsing means, which is used for rinsing the foil bag so as to displace the disinfecting gaseous medium. Such rinsing can be effected e.g. by introducing preferably disinfected and/or sterile air which will displace the gaseous disinfecting medium.

It is also possible to neutralize the disinfecting medium. For example, if a strongly oxidizing disinfecting gaseous medium is used, it can be neutralized by a reducing agent. This agent can also be used instead of rinsing.

BRIEF DESCRIPTION OF THE DRAWINGS

Advantageous embodiments of devices of the method and of the apparatus are shown in the figures, in which.

DETAILED DESCRIPTION OF THE DRAWINGS

Figures 1A, 1B, 1C, 1D, 1E:
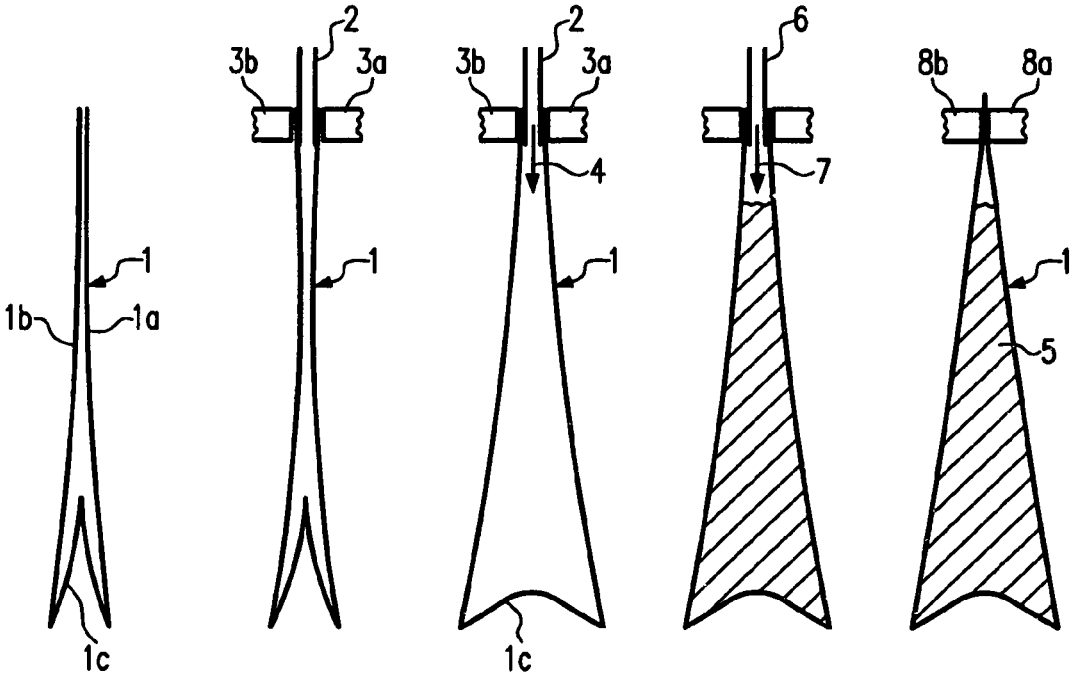
FIG. 1*a*-1*e* shows in a schematic representation the various states of a foil bag in the case of one embodiment of the present method.

In FIG. 1*a*, a foil bag 1 provided in a flat, folded condition is shown. FIG. 1*a* shows a section through the foil bag 1. The foil bag 1 comprises two lateral foils 1*a* and 1*b* as well as a bottom foil 1*c*.

In FIG. 1*b*, it is shown how a small tube 2 has been introduced in the upper end of the foil bag 1. Jaws 3*a* and 3*b* are arranged laterally to the upper end of the foil bag 1, a flow of gas from the interior of the foil bag 1 to the outside being largely prevented by said jaws.

A gaseous medium is now blown into the foil bag 1 through said small tube 2 (cf. the arrow 4 in FIG. 1*c*). Due to the fact that the upper end of the foil bag 1 is closed by the jaws 3*a* and 3*b* and the small tube 2, the foil bag 1 is inflated and shaped at least partially in this way. The two superimposed lateral foils 1*a* and 1*b* are separated from one another and the folded bottom foil 1*c* is unfolded at least partially (cf. FIG. 1*c*).

A cavity now exists in the thus shaped foil bag 1; this cavity can be filled with a liquid filling material.

In FIG. 1*d* it is shown how a small tube 6, which may be identical with or different from the small tube 2, is used for filling liquid filling material 5 into the foil bag 1 (cf. the arrow 7 in FIG. 1*d*).

As can be seen, the cavity created in the foil bag 1 is filled to a large extent by the liquid medium.

The thus filled foil bag 1 is then welded by means of welding jaws 8*a* and 8*b* at the upper end thereof and sealed in this way (cf. FIG. 1*e*).

By blowing a disinfecting gaseous medium into the foil bag 1, as indicated by arrow 4 in FIG. 1*c*, the interior of the foil bag 1 is disinfected. Since the foil bag 1 itself is empty before said medium is blown in (cf. FIG. 1*b*), the disinfecting gaseous medium will reach the whole interior of the foil bag so that said foil bag will be disinfected reliably in the whole inner area thereof.

According to a special embodiment, the foil bag 1, after having been shaped at least partially and disinfected as shown in FIG. 1*c*, is evacuated, whereby it will reassume the shape shown in FIG. 1*b*. Subsequently, the bag will be shaped once more so that it will reassume the shape shown in FIG. 1*c*. The thus shaped and disinfected foil bag 1 can then be filled as shown in FIG. 1*d*.

It is also possible to first evacuate the foil bag 1 by means of the small tube 2, as shown in FIG. 1*b*, and to remove any residual amount of air from the bag interior in this way. Subsequently, the small tube 2 can be used, in the manner shown in FIG. 1*c*, for filling the interior of the bag with the disinfecting gas so that said interior will be disinfected. The preceding evacuation has the effect that the disinfecting medium will reach the inner folds of the foil bag even more effectively and that the disinfecting effect will be improved in this way.

The same small tube 2 which is used for inflating the bag can also be used for evacuating it; it is, however, also possible to use different means for these purposes.

Figure 2:
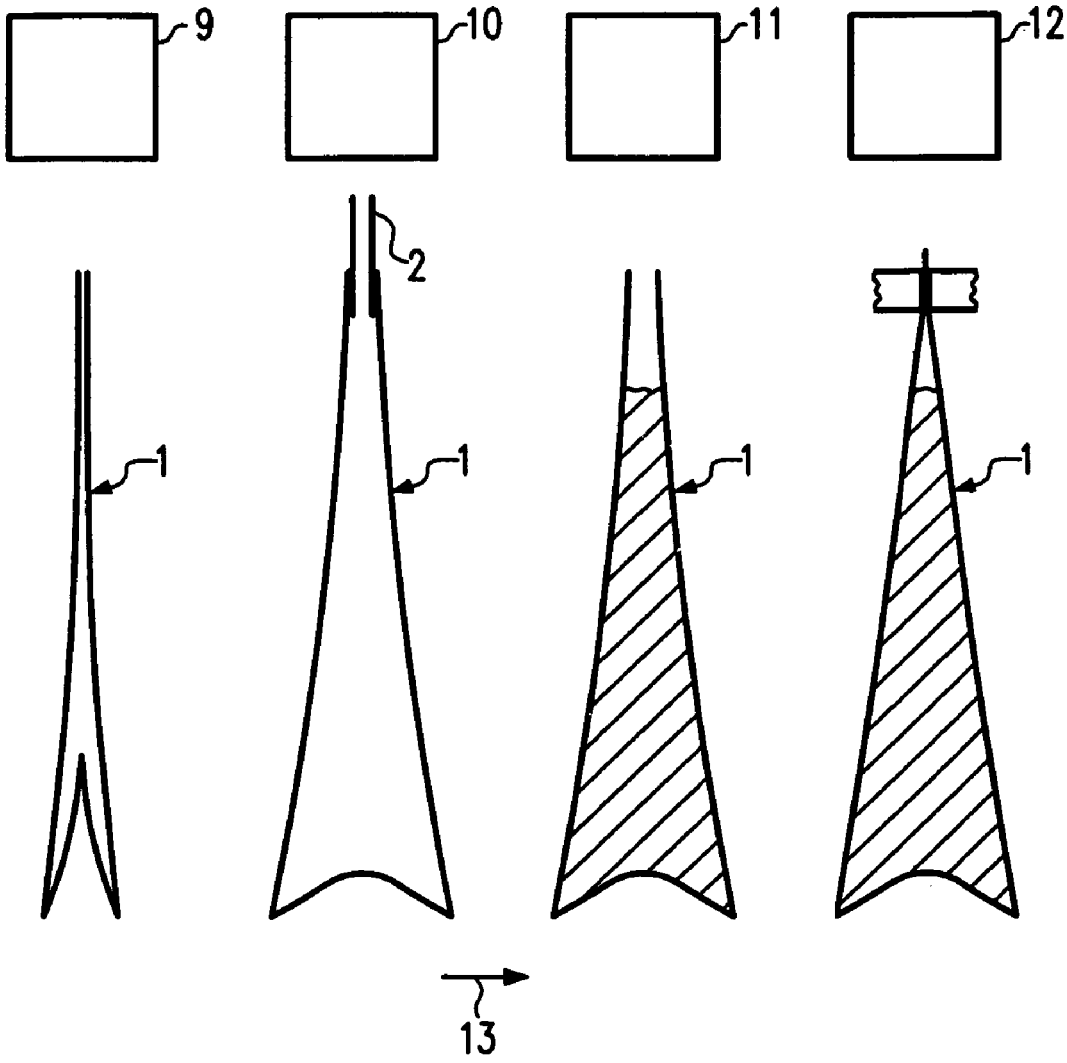
FIG. 2 shows a schematic representation of an apparatus for filling flexible foil bags.

FIG. 2 shows schematically an apparatus for filling flexible foil bags.

The foil bags can be conveyed in direction 13 by a conveyor, which is not shown. While being conveyed, the foil bags are held, in a suspended condition, at the upper end thereof.

In a first station 9, the foil bags 1 can be taken up by the conveyor.

In a shaping unit 10, the foil bags are inflated with the gaseous medium through the small tube 2 and shaped in this way.

Downstream of the shaping unit 10, a filling unit 11 is arranged, by means of which the foil bags 1 can be filled.

Downstream of said filling unit 11, a sealing station 12 is provided, by means of which the foil bags can be sealed.

Downstream of said sealing station 12, a cooling unit or a removal unit for removing the foil bags 1 from the conveyor can be provided.

Figure 3A:
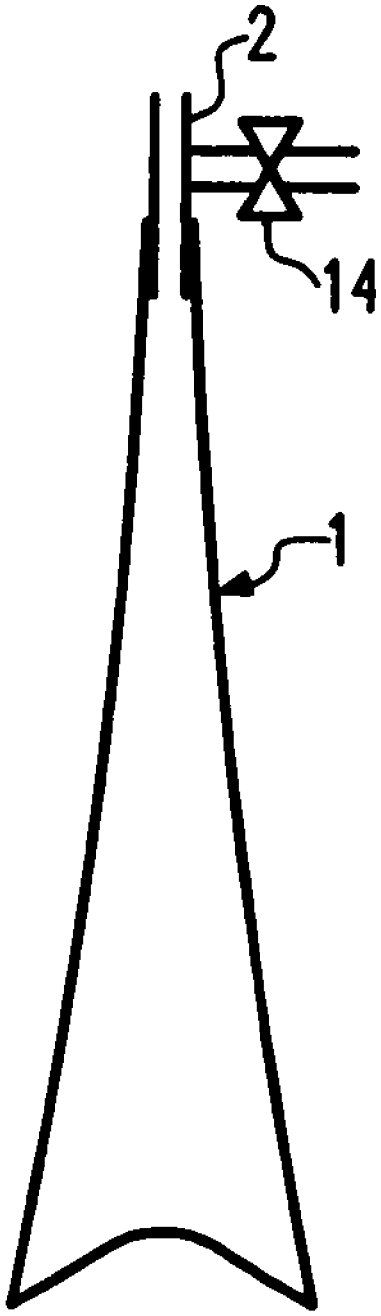
FIGS. 3*a* and 3*b* shows a schematic representation of a shaping unit.
Figure 3B:
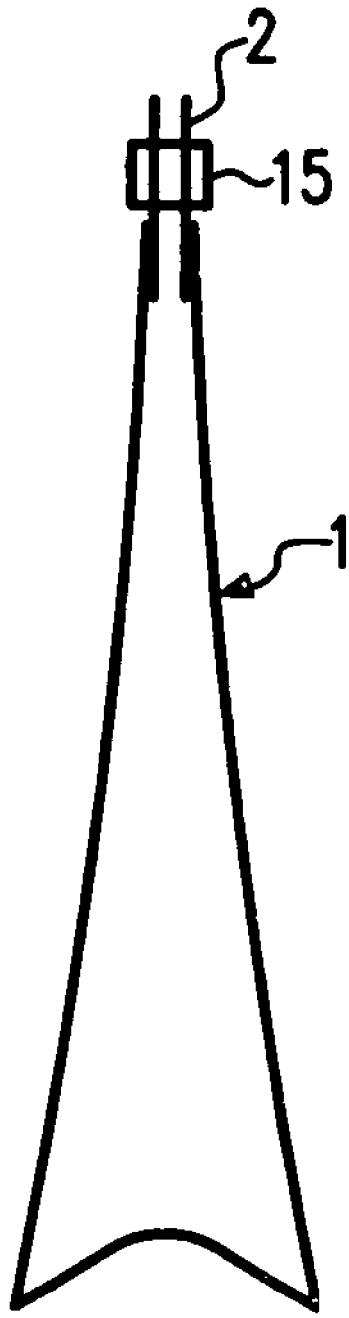

Embodiments of the shaping unit 10 are shown in FIG. 3*a* and 3*b*.

FIG. 3*a* shows a foil bag 1 together with the small tube 2. The small tube 2 can have supplied thereto ozone, hydrogen peroxide or the like through a valve 14. The valve 14 is here arranged in a feed line leading to the small tube 2. This allows a carrier gas to be mixed with a medium producing the disinfecting effect.

FIG. 3*b* shows a unit 15 by means of which a disinfecting effect of the gaseous medium can be achieved.

This unit may, on the one hand, be a heating unit which heats the gaseous medium so that it will be rendered disinfecting on the basis of its temperature. On the other hand, it may, however, also be a unit which produces ozone e.g. by means of irradiation with ultraviolet light, so that the gaseous medium will be rendered disinfecting due to the ozone.

It is also possible to provide between the station 9 and the shaping unit 10 an additional evacuating station which can be can be used for evacuating the interior of the foil bag 1. This evacuation possibility may, however, also be integrated in the shaping unit 10, which means that evacuation can be effected through the small tube 2. For this purpose, a suitable vacuum pump or the like is connected to or is adapted to be connected to said small tube 2 on the apparatus-side end.

An evacuating unit may also be arranged between the shaping unit 10 and the filling unit 11.

In this case, evacuation serves to remove the gaseous medium producing the disinfecting effect. It will then be advantageous to provide a further shaping unit after this intermediate evacuating unit and the filling unit 11.

The invention claimed is:

1. A method of expanding a flexible foil bag prior to filling the bag with a liquid, the method consisting essentially of:

providing a flattened foil bag;

inflating the foil bag by introducing a disinfecting gaseous medium for inflating the foil bag to create a cavity therein and simultaneously disinfecting the cavity of the foil bag prior to filling the foil bag with a liquid; and filling the foil bag with a liquid, whereby the gaseous medium is displaced from the foil bag.

2. A method according to, claim 1, wherein the gaseous medium is selected from the group consisting of ozone, hydrogen peroxide, and mixtures thereof.

3. A method according to, claim 1, wherein the liquid is a beverage.

4. A method according to, claim 1, wherein the inflating the foil bag comprises partially inflating the foil bag with the gaseous disinfecting medium, and then fully inflating the foil bag with one of a disinfected medium, or a sterile medium.

5. A method of expanding a flexible foil bag prior to filling the bag with a liquid, the method consisting essentially of:

providing a flattened foil bag;

inflating the foil bag by introducing a disinfecting gaseous medium for inflating the foil bag to create a cavity therein and simultaneously disinfecting the cavity of the foil bag prior to filling the foil bag with a liquid;

removing one or more gases from the foil bag before inflating the foil bag; and filling the foil bag with a liquid, whereby the gaseous medium is displaced from the foil bag.

6. A method of expanding a flexible foil bag prior to filling the bag with a liquid, the method consisting essentially of:

providing a flattened foil bag;

inflating the foil bag by introducing a disinfecting gaseous medium for inflating the foil bag to create a cavity therein and simultaneously disinfecting the cavity of the foil bag prior to filling the foil bag with a liquid;

removing one or more gases from the foil bag after inflating the foil bag, and subsequently inflating the foil bag by introducing one of a disinfected gaseous medium, a sterile gaseous medium, the liquid, and mixtures thereof; and filling the foil bag with a liquid, whereby the gaseous medium is displaced from the foil bag.

7. A method of expanding a flexible foil bag prior to filling the bag with a liquid, the method consisting essentially of:

providing a flattened foil bag;

inflating the foil bag by introducing a disinfecting gaseous medium for inflating the foil bag to create a cavity therein and simultaneously disinfecting the cavity of the foil bag prior to filling the foil bag with a liquid;

rinsing the foil bag with one of a disinfected medium, a sterile medium, and mixtures thereof after inflating the foil bag; and filling the foil bag with a liquid, whereby the gaseous medium is displaced from the foil bag.

8. A method of expanding a flexible foil bag prior to filling the bag with a liquid, the method consisting essentially of:

providing a flattened foil bag;

heating a gaseous medium before introducing the gaseous medium into the foil bag;

inflating the foil bag by introducing the disinfecting gaseous medium for inflating the foil bag to create a cavity therein and simultaneously disinfecting the cavity of the foil bag prior to filling the foil bag with a liquid;

filling the foil bag with a liquid, whereby the gaseous medium is displaced from the foil bag.

9. A system for filling flexible foil bags consisting essentially of:

an inflating assembly constructed and arranged to inflate a flattened foil bag to create a cavity within the foil bag and disinfect the cavity of the foil bag by introducing a disinfecting gaseous medium into the foil bag, a filling assembly constructed and arranged to displace the disinfecting gaseous medium and fill the foil bags with a liquid, and a disinfecting assembly constructed and arranged to render the gaseous medium disinfecting.

10. The system according to claim 9, wherein the disinfecting assembly comprises a heating assembly constructed and arranged to either heat the gaseous medium or add one of ozone and/or hydrogen peroxide to the gaseous medium.

11. The system according to claim 9, wherein the inflating assembly and the filling assembly are separate assemblies.

12. A system for filling flexible foil bags consisting essentially of:

an inflating assembly constructed and arranged to inflate a flattened foil bag to create a cavity within the foil bag and disinfect the cavity of the foil bag by introducing a disinfecting gaseous medium into the foil bag;

a filling assembly constructed and arranged to displace the disinfecting gaseous medium and fill the foil bags with a liquid;

a disinfecting assembly constructed and arranged to render the gaseous medium disinfecting; and an evacuating assembly constructed and arranged to remove one or more gases from the foil bag.

13. A system for filling flexible foil bags consisting essentially of:

an inflating assembly constructed and arranged to inflate a flattened foil bag to create a cavity within the foil bag and disinfect the cavity of the foil bag by introducing a disinfecting gaseous medium into the foil bag;

a filling assembly constructed and arranged to displace the disinfecting gaseous medium and fill the foil bags with a liquid;

a disinfecting assembly constructed and arranged to render the gaseous medium disinfecting; and a sealing assembly constructed and arranged to seal the foil bag.

14. A method of filling flexible foil bags with a liquid, the method comprising:

providing a flattened foil bag having an opening and an inside;

inserting a gas tube into the opening of the foil bag;

inflating the foil bag by introducing a disinfecting gaseous medium into the foil bag for inflating and disinfecting the foil bag;

inserting a liquid tube into the opening of the foil bag, the liquid tube being different from the gas tube; and filling the foil bag with a liquid.

15. A method of filling flexible foil bags with a liquid, the method comprising:

providing a flattened foil bag having an inside;

separating two sides of the foil bag to open the foil bag;

introducing a disinfecting gas into the foil bag; wherein the gas disinfects the inside of the foil bag; and filling the foil bag with a liquid.

16. The method of claim 15 further comprising:

rinsing the foil bag with one of a disinfected medium, a sterile medium, and mixtures thereof.

* * * * *